US005836322A

United States Patent [19]

Borger et al.

[11] Patent Number: 5,836,322

[45] Date of Patent: Nov. 17, 1998

[54] STORAGE AND CLEANING UNIT FOR A TOILET PLUNGER

[76] Inventors: Nancy G. Borger; Gary A. Borger, both of 5001 Packer Dr., Wausau, Wis. 54401

[21] Appl. No.: 852,805

[22] Filed: May 7, 1997

[51] Int. Cl.[6] ..... B08B 7/00; B65D 83/00

[52] U.S. Cl. ..... 134/42; 134/183; 206/15.3; 206/361

[58] Field of Search ..... 134/22.1, 42, 183; 206/361, 15.2, 15.3, 229; 4/664, 340, 363, 661, 255.05, 255.11

[56] References Cited

U.S. PATENT DOCUMENTS

| | | | |
|---|---|---|---|
| 242,254 | 5/1881 | Bird | 220/252 |
| 245,728 | 8/1881 | Landis | 220/252 |
| D. 279,145 | 6/1985 | Lippe | D3/75 |
| D. 315,269 | 3/1991 | Brazis | D6/551 |
| D. 343,058 | 1/1994 | Allegre | D3/39 |
| D. 362,575 | 9/1995 | Bird et al. | D6/551 |
| 2,757,787 | 8/1956 | Sergent | 206/361 X |
| 3,229,846 | 1/1966 | Katz | 220/252 |
| 3,361,507 | 1/1968 | O'neil | 206/361 X |
| 3,640,420 | 2/1972 | Carter et al. | 220/592.2 |
| 4,776,456 | 10/1988 | Lewis | 206/15.3 |
| 5,114,006 | 5/1992 | Wilk | 206/349 |
| 5,305,880 | 4/1994 | Wilk et al. | 206/349 |
| 5,307,930 | 5/1994 | Wilk et al. | 4/255.11 X |
| 5,335,374 | 8/1994 | Wilk et al. | 4/255.11 |
| 5,456,356 | 10/1995 | Kurzawa | 206/349 |
| 5,772,015 | 6/1998 | Musiel et al. | 206/15.3 |

FOREIGN PATENT DOCUMENTS

| | | | |
|---|---|---|---|
| 219339 | 12/1957 | Australia | 206/361 |

*Primary Examiner*—Robert Warden
*Assistant Examiner*—Saeed Chaudhry
*Attorney, Agent, or Firm*—Margaret M. Liss; Stroud, Stroud, Willink Thompson & Howard

[57] ABSTRACT

A device for storing and cleaning a toilet plunger includes an open-topped container and a lid having two lid-halves with each lid-half having an interior surface and an exterior surface. An internal closure mechanism having two closure members is disposed within the lid with one closure member projecting from the interior surface in each lid-half. Each closure member has a curved member for engaging a side wall of a toilet plunger cup and a linear member for engaging a toilet plunger cup end wall. The container has a base having upstanding walls, a base top having grooves, a base top surface and an opposing bottom surface. A counterweight is preferably disposed under the base top surface. The container walls have a portion defining a pour spout. The container and the lid are dimensioned for enclosing both the toilet plunger cup and a portion of the toilet plunger handle. The remainder of the toilet plunger handle protrudes through a hole in the lid when the toilet plunger is in the device. A handle is affixed to the walls of the container. A method for opening and closing the device using a toilet plunger and a method of cleaning a toilet plunger are disclosed.

22 Claims, 10 Drawing Sheets

STORAGE AND CLEANING UNIT FOR A TOILET PLUNGER

BACKGROUND OF THE INVENTION

This invention relates generally to bathroom accessories and in particular, to a device for storing and cleaning a toilet plunger.

Toilet plungers have long been used to unblock drains. Such toilet plungers are difficult to store because of the limited amount of space in most bathrooms; in addition, toilet plungers are unsightly and unsanitary. Yet the toilet plunger should be readily available when necessary to remove blockages in the drains.

Some prior art has attempted to respond to the storage and convenience-of-use problems, providing toilet plunger covers and/or combination toilet plunger covers and toilet plungers. In U.S. Pat. No. 5,114,006 to Wilk, and U.S. Pat. Nos. 5,335,374 and 5,305,880 to Wilk et al., the toilet plunger housing is part of the toilet plunger. The Wilk ('006) combination toilet plunger and housing device has a housing with a slotted base which rests directly on the floor, wherein the plunger cup rests upon the slots when the plunger is in storage, and the same slots are used for grasping of the housing when the plunger is extended for use. Other embodiments of Wilk ('006) disclose the plunger cup resting on a removable base plate when the plunger is in a storage position.

Wilk et al. ('880) discloses a combination toilet plunger and housing device where the housing has an open end resting on the floor and the toilet plunger in the stored position has its plunger cup directed to the floor.

Wilk et al. ('374) discloses a combination toilet plunger and housing device having an open ended tubular housing member which covers the plunger cup allowing the plunger cup to rest directly on the floor. The handle of the device permits telescoping in the stored position.

U.S. Pat. No. 5,456,356 to Kurzawa discloses a combination toilet plunger cover and toilet tissue roll having a detachable base plate. The top surface of the base plate has upwardly extending ribs on which the plunger cup rests to prevent drainage of a wet plunger onto a floor. The Kurzawa device generally conforms to the shape of a toilet plunger cup and handle, having an elongate handle portion covering the entire toilet plunger handle.

Thus, notwithstanding the many known practical design problems for bathroom accessory storage devices for toilet plungers, the art has not adequately responded to date with the introduction of a device for storing and cleaning a toilet plunger which permits the user to easily insert a toilet plunger into an open device, without the user touching the plunger cup or the exterior or the interior of the device to close the device, and at the same time, to have the insertion action close the device; which also permits the user to remove the toilet plunger from within a closed device, without the user manipulating the device externally to open the device and without the user touching the plunger cup or the interior of the device to open the device, and have the removal action open the device; which permits the toilet plunger to drain inside the device without draining on the bathroom floor and to contain the drainage; which resists tipping of the device in the storage position, as well as when the toilet plunger is removed from the device; and which permits easy cleaning and sanitizing of the toilet plunger when it is inserted in the device.

BRIEF SUMMARY OF THE INVENTION

The present invention provides an improved device for storing and cleaning a toilet plunger which permits the user to easily insert and to easily remove the toilet plunger without touching the plunger cup of the toilet plunger or the interior of the device. The present invention permits the user to insert a toilet plunger into the open device of the present invention, while the insertion action advantageously closes the device without the user having to touch the device, or the plunger cup of the toilet plunger. Subsequently the user can remove the toilet plunger from within the closed device, without the user manipulating the device externally to open the device and without the user touching the plunger cup or the interior of the device to open the device. The removal action of the toilet plunger by the user advantageously opens the device.

The device also advantageously permits the toilet plunger to drain inside the device without draining on the bathroom floor and permits the drainage to collect in the device. Further, the device of the present invention resists tipping when the device is in the storage position and when the plunger is removed from within the device. The device in accordance with the present invention has yet a further advantage in that the device is suitably configured to hold the toilet plunger, as well as cleaning solutions used for cleaning the toilet plunger. The device provides for drainage of the cleaning solutions after their use, as well as any fluids draining off the toilet plunger after its use. The cleaning feature allows the toilet plunger to be sanitized after use, thus reducing odor and the potential spread of bacteria and other infectious agents.

The foregoing, and other advantages of the present invention, are realized in one aspect thereof in a device for storing and cleaning a toilet plunger. The toilet plunger is of the conventional type having a handle and a cup disposed at the end of the handle. The cup has a sidewall terminating in an end wall. The device comprises an open-topped plunger-receiving container, an upper lid comprising two lid-halves, each lid-half having an interior surface and an exterior surface. The lid is preferably a curved lid having two curved lid-halves. The lid has a hole there through, with the hole penetrating the two lid-halves. A hinge mechanism pivotly connects each lid-half to the container permitting the lid-halves to open outside the container without telescoping on the container and without telescoping on each other. Each lid-half has an outwardly projecting tab on the exterior surface with the tab disposed near the hinge mechanism.

An internal closure mechanism is present for closing and opening the lid-halves using the toilet plunger. The internal closure mechanism comprises a pair of mirror-imaged closure members. The internal closure mechanism is disposed within the lid and extends from the interior surface of each lid half into the device and is adjacent the hole. The internal closure mechanism comprises a curved member for engaging the side wall of the cup of the toilet plunger and a linear member for engaging an end wall of the cup of the toilet plunger. One of each of the closure members projects from the interior surface of a lid-half into the device. Each closure member has a bumper and a lever. The bumper is adjacent the hole on the lid. The bumper portion has a D-shaped curved portion and an inwardly bent section, with the D-shaped curved portion directly adjacent to the inwardly bent section. The D-shaped curved portion is suitable for engaging the side wall of the cup of the toilet plunger for opening the lid-halves from within the device. The lever has a generally truncated triangular shape with a first side, an opposite second side and a third side connecting the first side and the second side. The first side is continuous with the inwardly bent section of the bumper. The first side forms a linear portion which is suitable for engaging the end wall of the cup of the toilet plunger for closing the lid-halves. Preferably, a flange extends perpendicularly from the closure member providing each bumper and each lever with a T-bar cross-section shape. Alternatively, the flange is absent and the closure member has a rectangular cross-section.

The container has a base having upstanding side walls. The base has a base top having a top surface and an opposing base bottom having a bottom surface. The base top also has a plurality of grooves. A counterweight is preferably disposed within the base between the top surface and the bottom surface. Alternatively, the counterweight is recessed into the bottom surface of the base. Yet, alternatively, the counterweight is absent. The base further comprises a rim extending from the base and continuous with the walls. The rim is suitable for use as a fingerhold.

The container walls have a spout portion defining a pour spout. Preferably, a detachable handle is releasably affixed to the container.

The container and the lid are dimensioned for enclosing both the cup of the toilet plunger and a portion of a handle of the toilet plunger, with the remainder of the handle protruding through the hole in the lid when the plunger is in the container.

In another aspect of the present invention, a method for opening and closing a toilet plunger storing and cleaning device, using a toilet plunger is disclosed. The toilet plunger is of the conventional type having a handle, and a cup disposed at the end thereof and having a sidewall terminating in an end wall. The method comprises the steps of: (a) opening a device having (i) an open-topped container having an interior, (ii) a lid thereto having two lid-halves and a hole there through, (iii) a hinge mechanism connecting each lid-half to the container, and (iv) an internal closure mechanism disposed within the lid and adjacent the hole; the hole penetrating the two lid-halves; each lid-half having an interior surface, an exterior surface, and a tab extending from the exterior surface; the internal closure mechanism having a curved portion for engaging the side wall of the cup of the toilet plunger and a linear portion for engaging the end wall of the cup of the toilet plunger; by depressing each tab of the lid-halves causing each of the lid-halves to pivot about the hinge mechanism to open and expose the interior of the container; (b) lowering the toilet plunger into the interior of the container; (c) engaging the end wall of the cup of the toilet plunger against the linear portion, causing the lid-halves to pivot shut to close the device; (d) resting the end wall of the cup of the toilet plunger in the container and enclosing both the cup of the toilet plunger and a portion of the handle of the toilet plunger and wherein a remainder of the handle protrudes through the hole in the lid; (e) grasping the handle and pulling the handle toward the lid-halves; and (f) engaging the side wall of the cup of the toilet plunger against the curved portion, causing the lid-halves to pivot open to open the device.

In yet another aspect of the present invention, a method of cleaning a toilet plunger using a device for storing and cleaning a toilet plunger is disclosed. The toilet plunger is of the conventional type having a handle, and a cup disposed at the end thereof and having a sidewall terminating in an end wall. The method comprises the steps of: (a) opening a device comprising (i) an open-topped container having an interior defined by upstanding walls and a base, said walls having a spout portion defining a pour spout, (ii) a lid having two lid-halves and a hole there through, each lid-half having an interior surface and an exterior surface, and a tab extending from the exterior surface; the hole penetrating the two lid-halves, (iii) a hinge mechanism connecting each of the lid-halves to the container, and (iv) an internal closure mechanism disposed within the lid and adjacent the hole, the internal closure mechanism having a curved portion for engaging the side wall of the cup of the toilet plunger and a linear portion for engaging the end wall of the cup of the toilet plunger, by depressing the tabs on the lid-halves causing each of the lid-halves to pivot about the hinge mechanism opening and exposing the interior of the container; (b) pouring a cleaning solution into the container; (c) lowering the toilet plunger into the container; (d) engaging the end wall of the cup of the toilet plunger against the linear portion, causing the lid-halves to pivot shut, closing the device; (e) resting the end wall of the cup of the toilet plunger in the container and enclosing both the cup of the toilet plunger and a portion of the handle of the toilet plunger and a remainder of the handle protrudes through the hole in the lid; (f) soaking the toilet plunger in the cleaning solution; and (g) tipping the device and draining the cleaning solution from the device through the pour spout.

Other advantages and a fuller appreciation of the specific attributes of this invention will be gained upon an examination of the following drawings, detailed description of preferred embodiments, and appended claims. It is expressly understood that the drawings are for the purpose of illustration and description only, and are not intended as a definition of the limits of the invention.

BRIEF DESCRIPTION OF THE DRAWING(S)

The preferred exemplary embodiment of the present invention will hereinafter be described in conjunction with the appended drawing wherein like designations refer to like elements throughout and in which.

Figure 1:
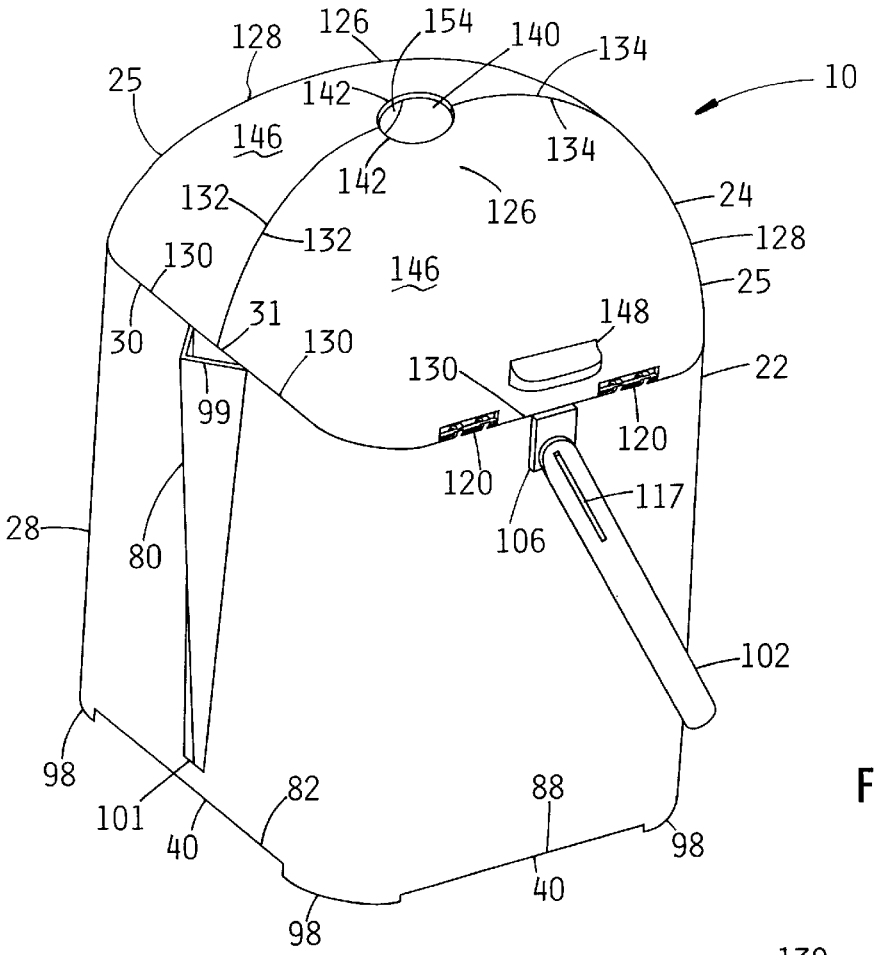
FIG. 1 is a perspective view of the front and side of the device for storing and cleaning a toilet plunger according to the present invention.
Figure 5:
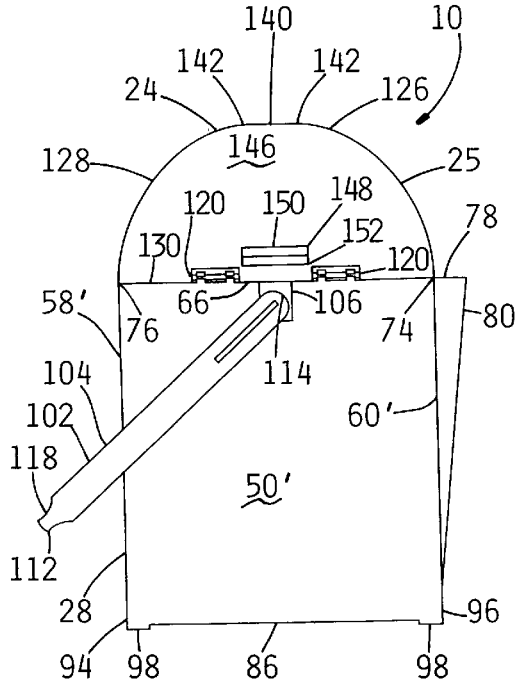
FIG. 5 is a left side view of the device of FIG. 1.
Figure 6:
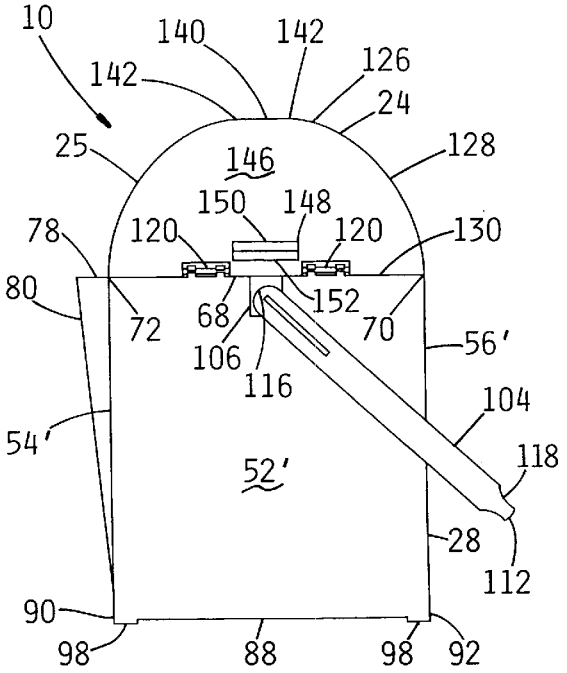
FIG. 6 is a right side view of the device of FIG. 1.
Figure 7:
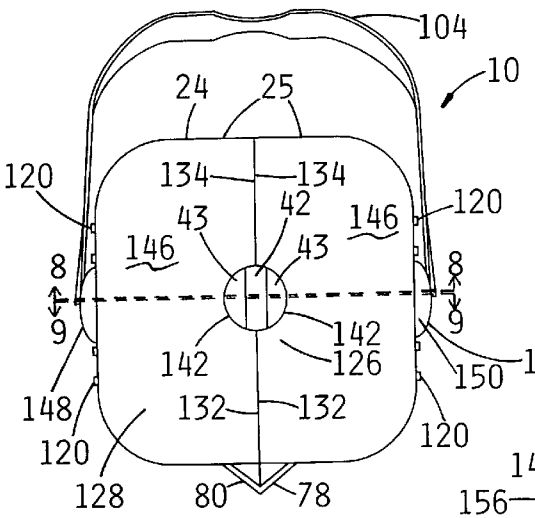
FIG. 7 is a top view of the device of FIG. 1.
Figure 10:
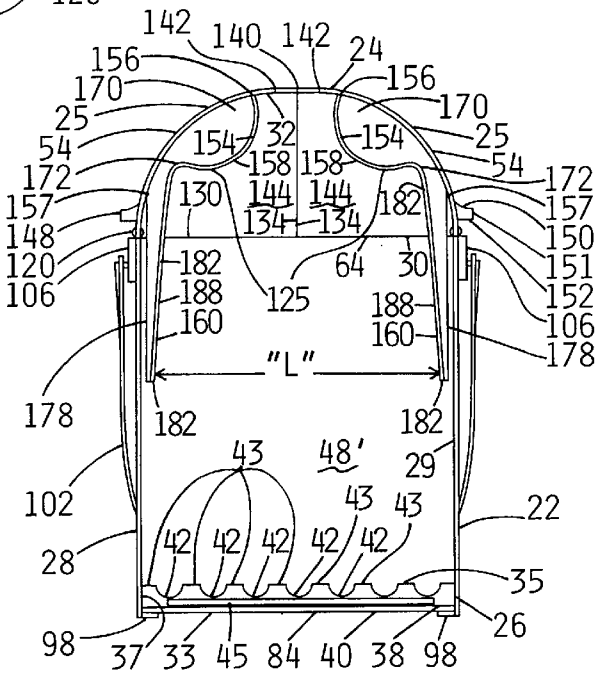
Figure 9:
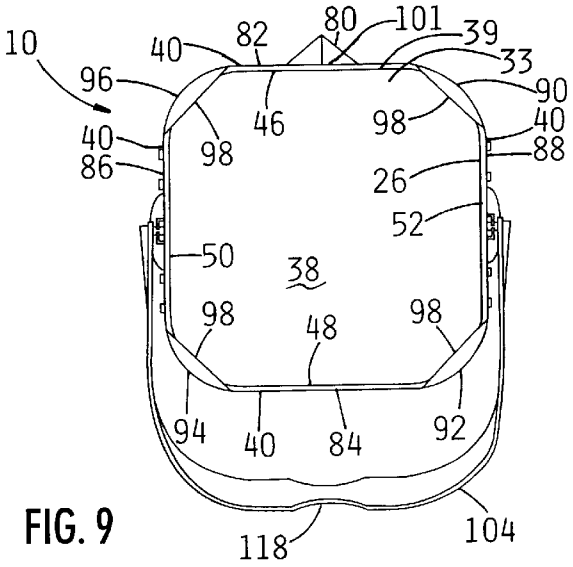
Figure 8A:
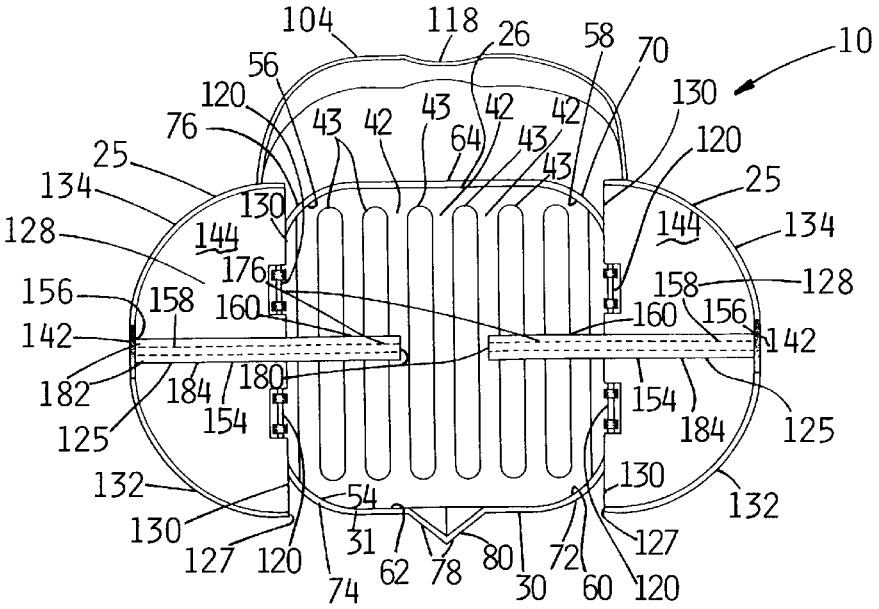
Figure 8B:
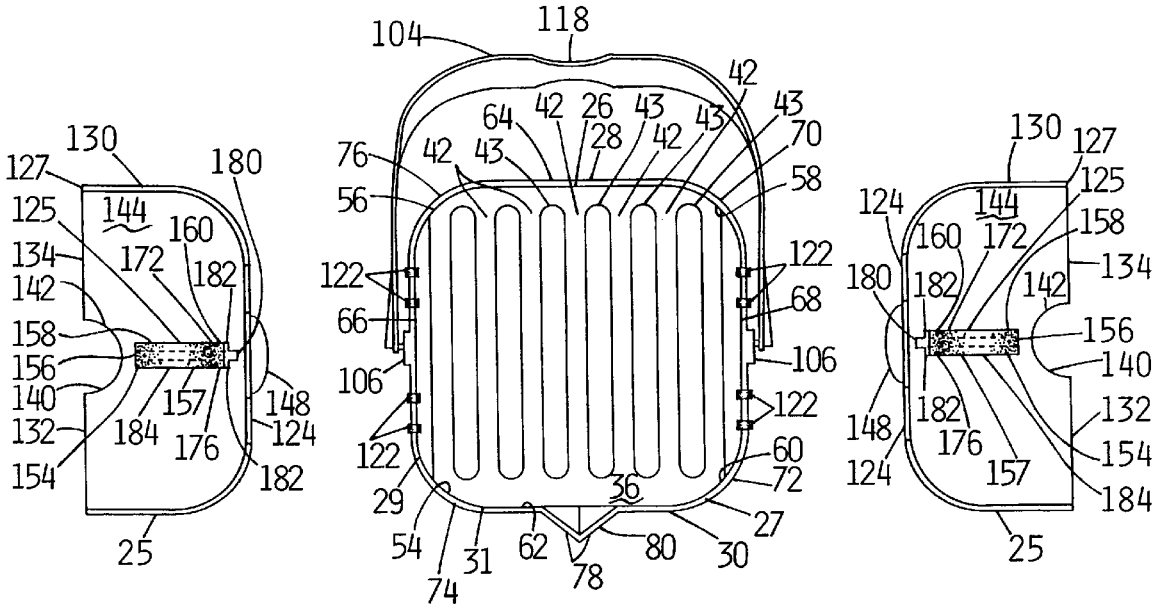
Figure 11:
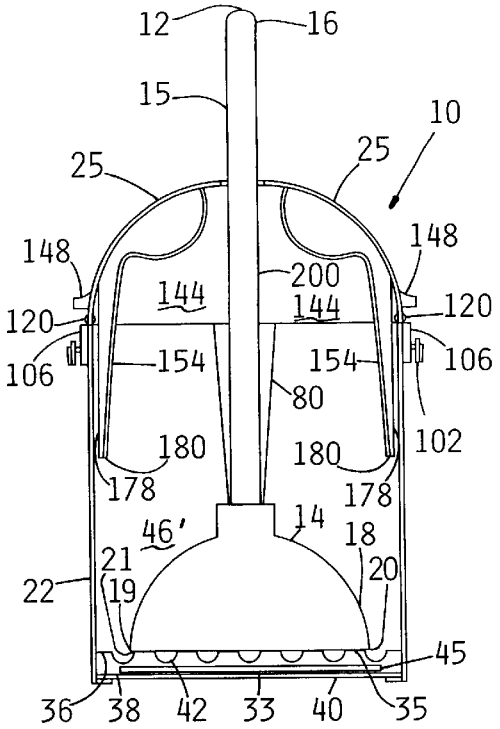
Figure 12A:
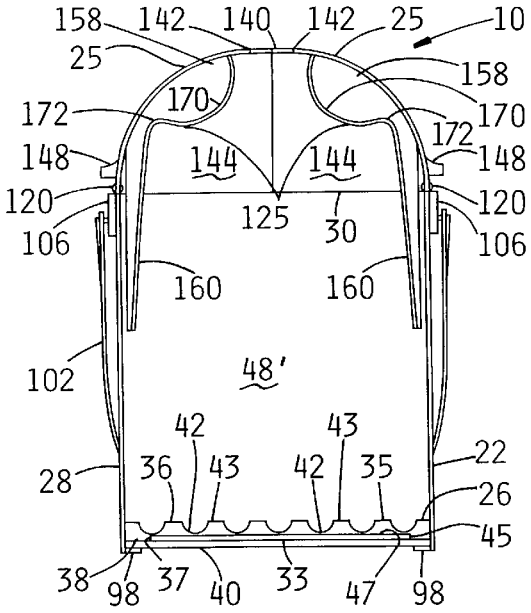
Figure 12B:
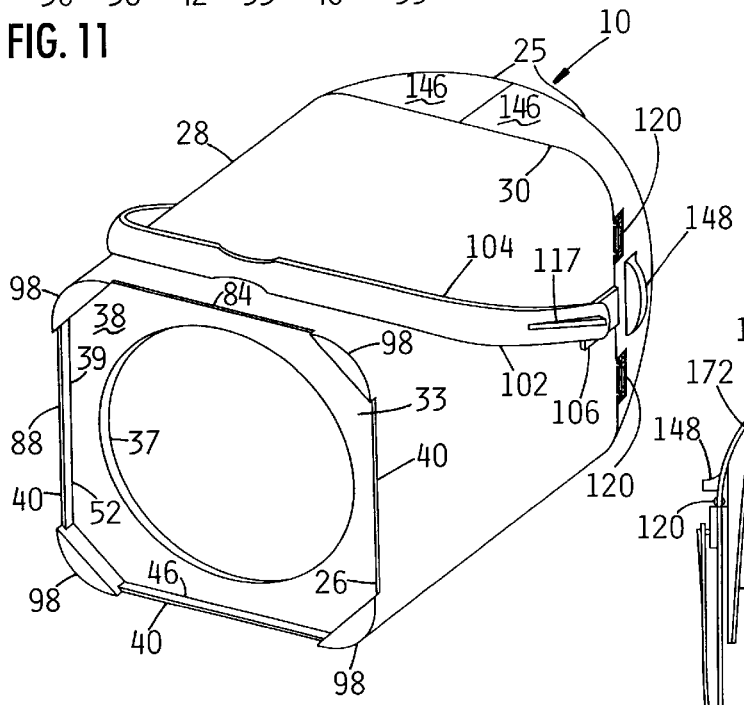
Figure 13:
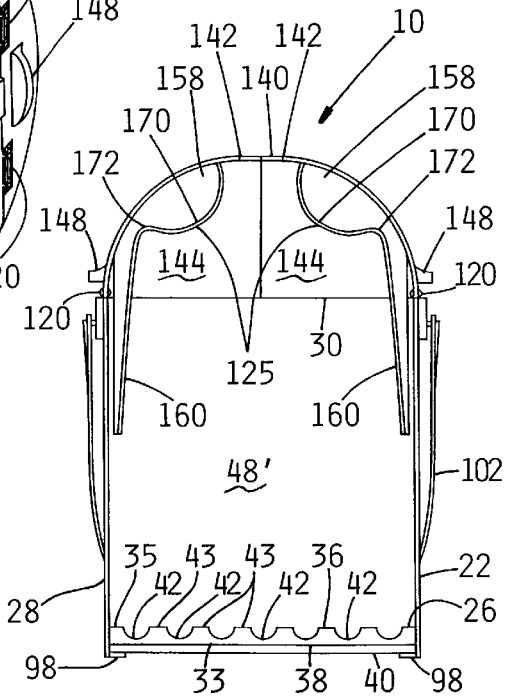
Figure 14:
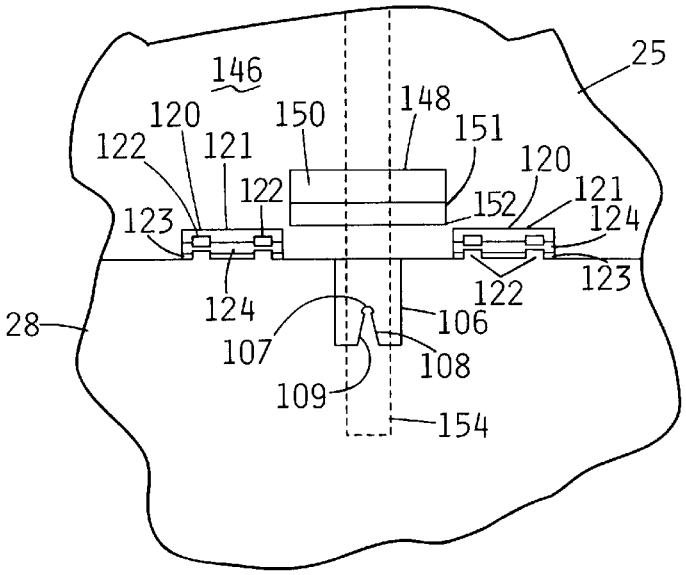
Figure 15:
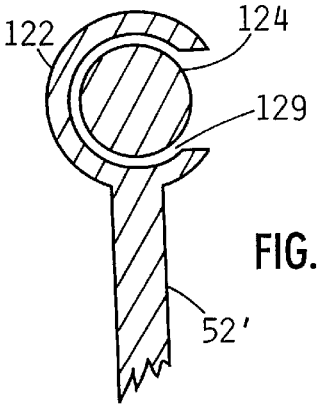
Figure 16:
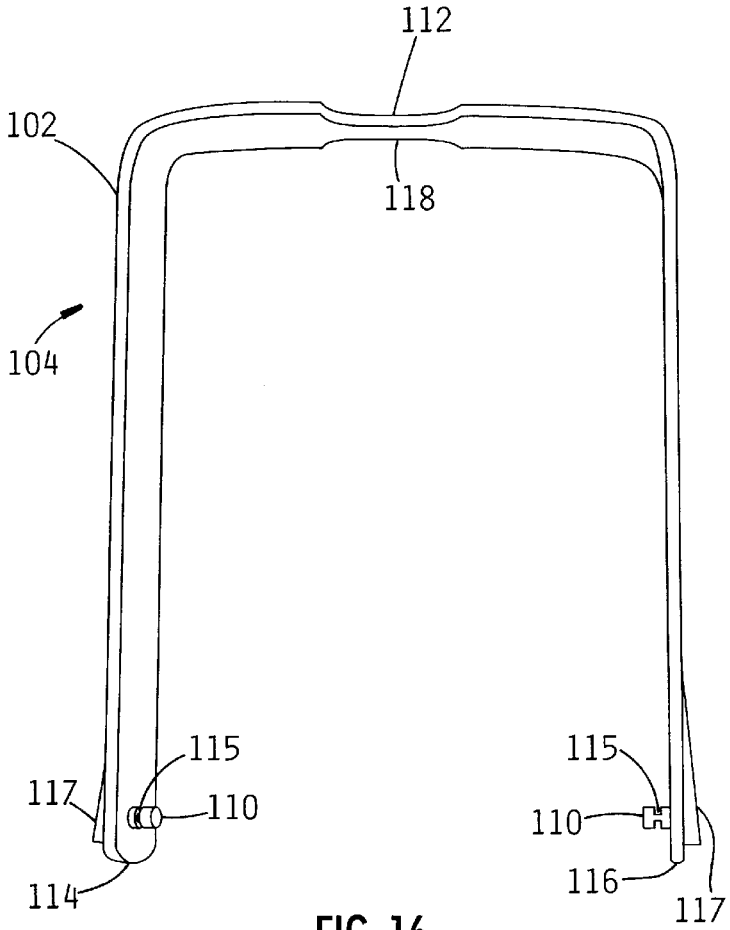
Figure 17:
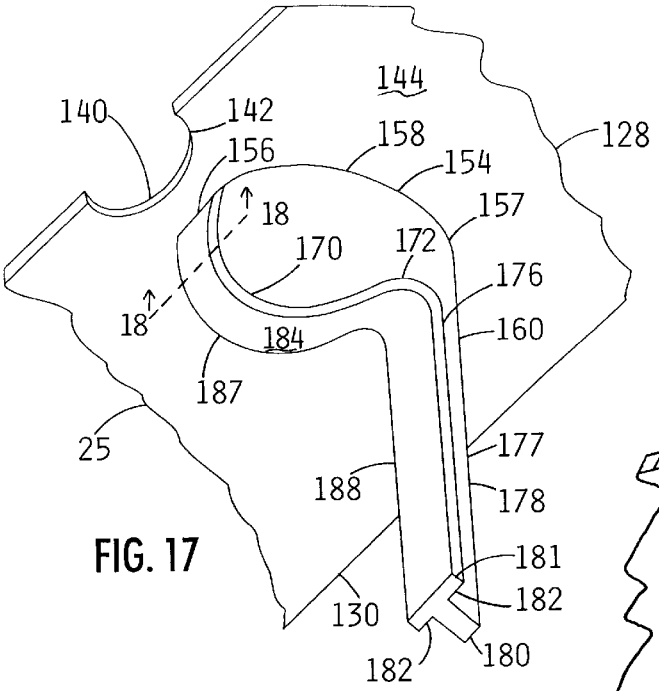
Figure 18:
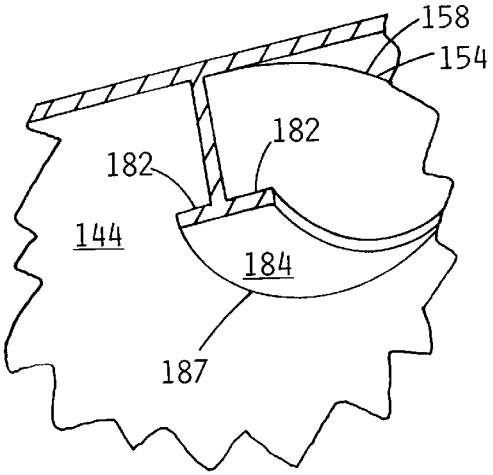
Figure 19:
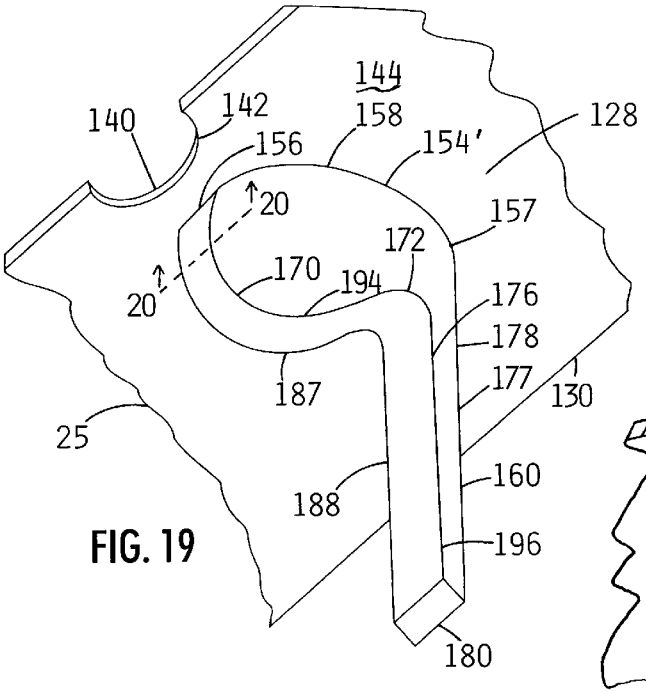
Figure 20:
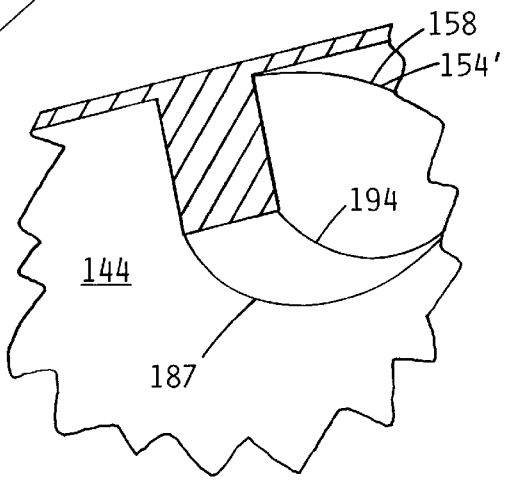
Figure 21A:
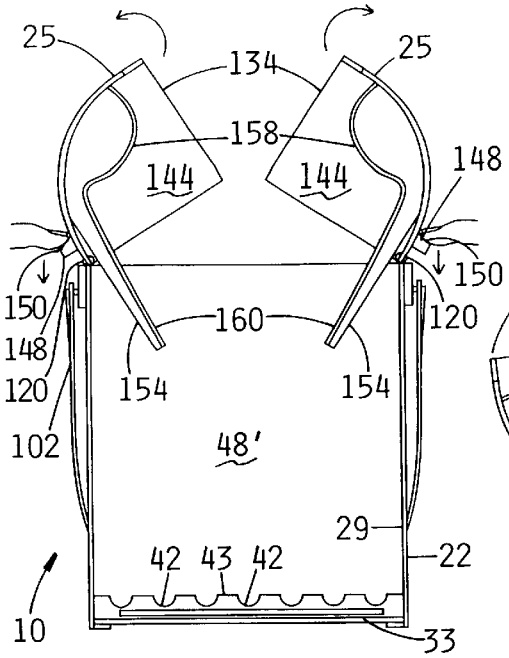
Figure 21B:
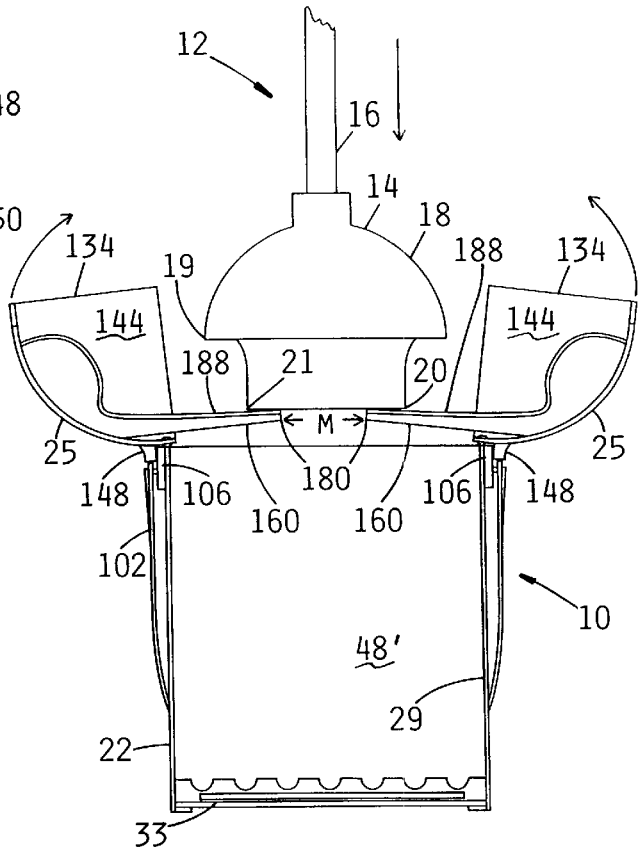
Figure 21C:
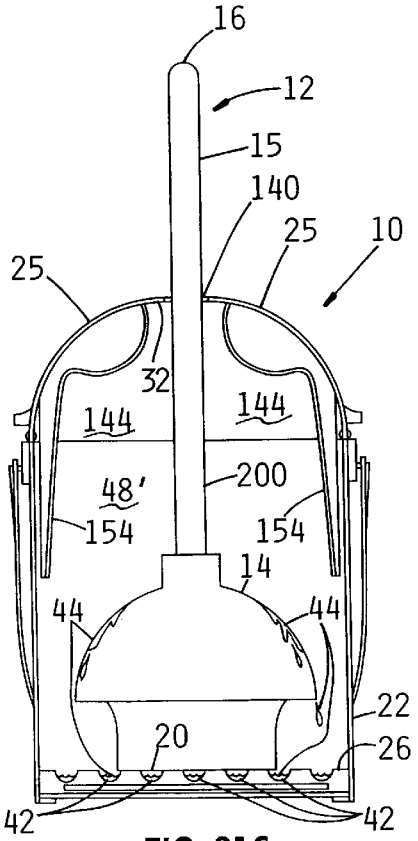
Figure 21D:
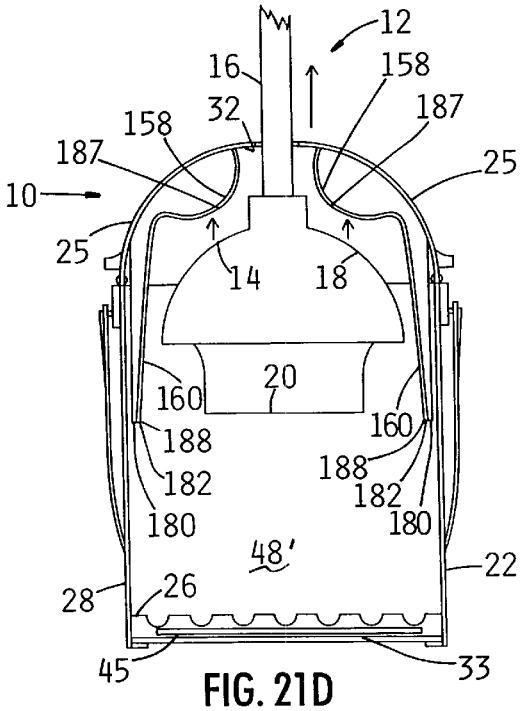
Figure 21E:
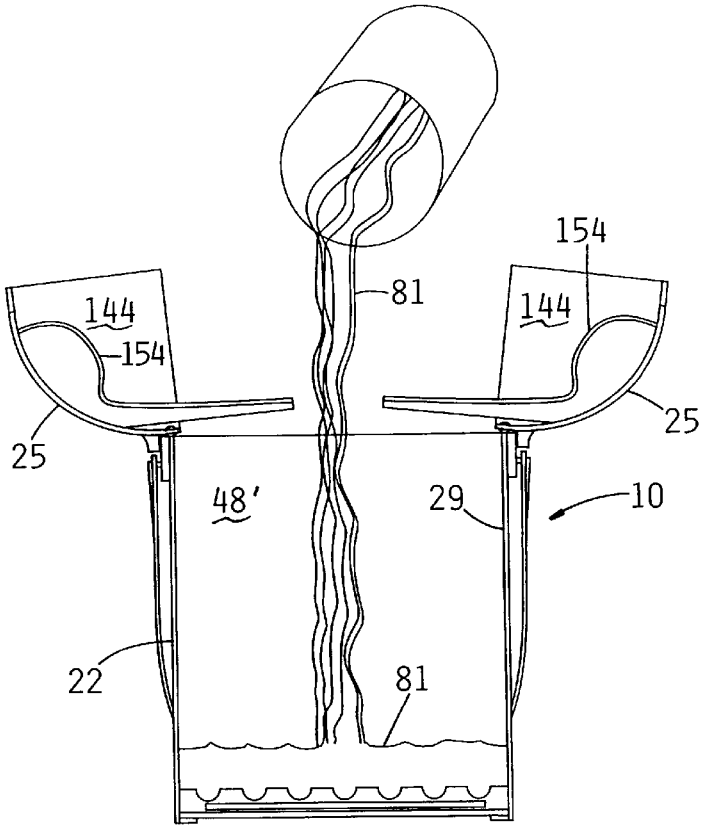
Figure 21F:
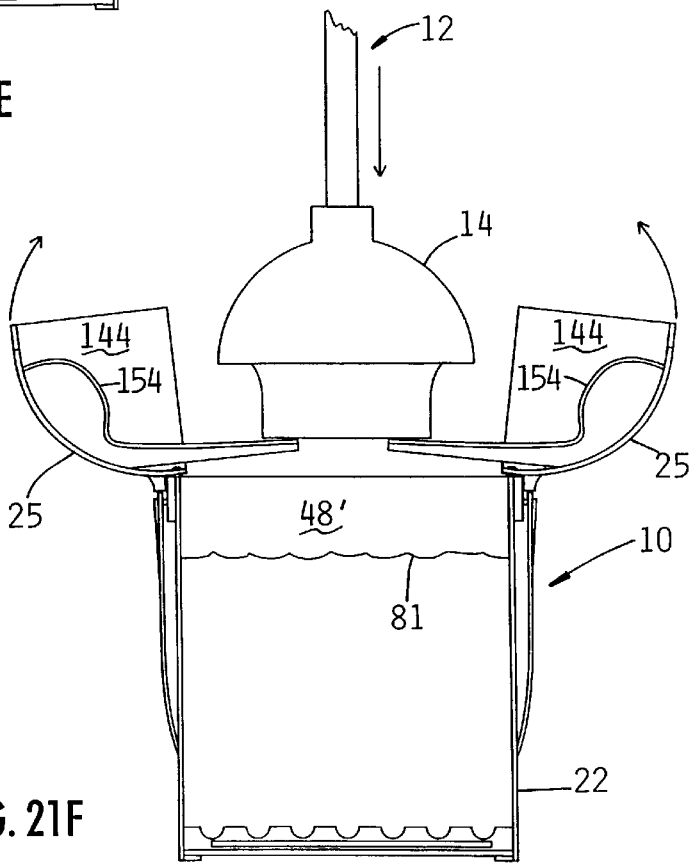
Figure 21G:
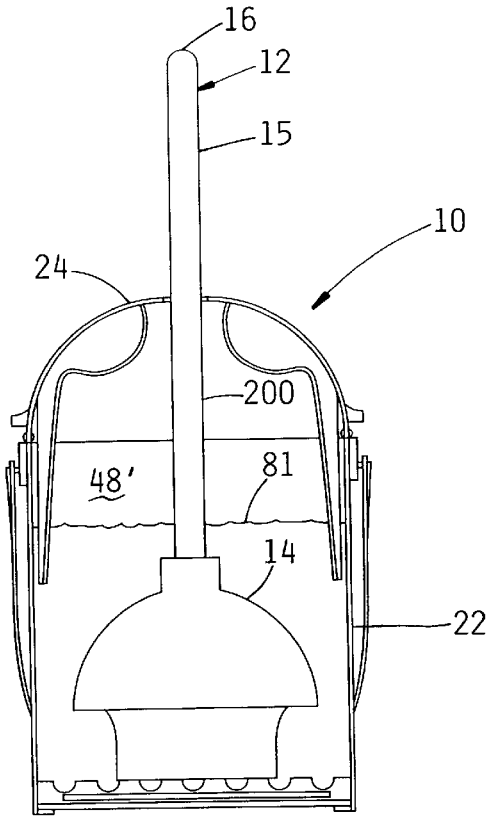
Figure 21H:
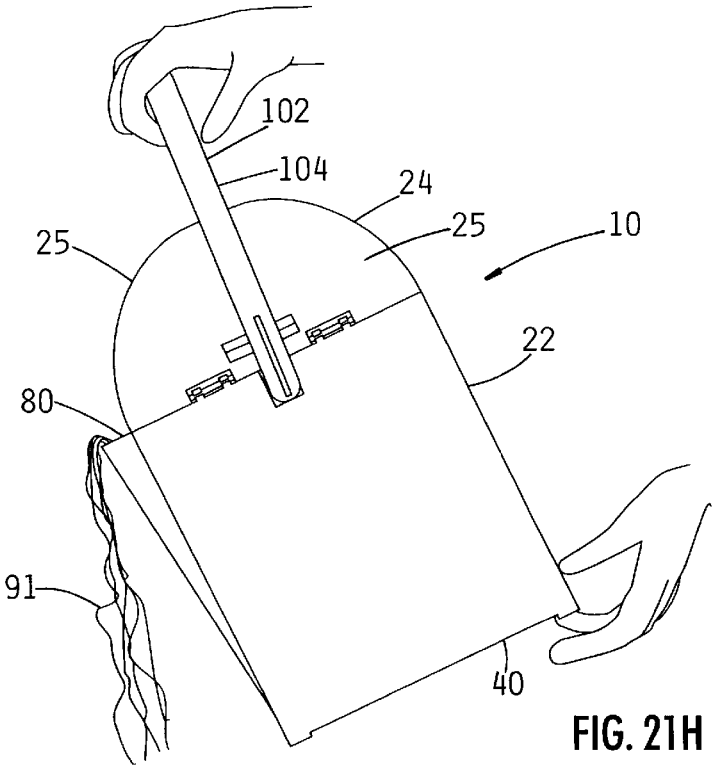

FIG. 8A is a top view of the device of FIG. 1, having the lid-halves open and showing the interior of the container and the interior of the lid-halves including the internal closure mechanism with the closure members having the T-bar construction; and with phantom lines showing the D-shaped curved portion and the inwardly bent portion of the bumper, and the first side of the lever of the closure member;

FIG. 8B is a top view of the device of FIG. 1 with the lid halves detached and removed from the container and oriented to show a top plan view of the interior of each of the lid halves, including the internal closure mechanism with the closure members having the T-bar construction; and with phantom lines showing the D-shaped curved portion and the inwardly bent portion of the bumper, and the first side of the lever of the closure member; the top plan view of the interior of the container is also shown;

FIG. 9 is a bottom view of the device of FIG. 1;

FIG. 10 is a cross-sectional view of the device of FIG. 7, taken along section line 8—8 and bisecting the device;

FIG. 11 is a schematic broken away cross-sectional view of the device of FIG. 7, taken along section line 9—9, showing a toilet plunger therein;

FIG. 12A is a cross-sectional view of the device as in FIG. 10, shown with an alternate placement of the counterweight;

FIG. 12B is a bottom perspective view of the device of FIG. 12A, without the counterweight, showing the detail of the rim, the recess for placement of the counterweight, the base lower surface and feet;

FIG. 13 is a cross-sectional view of the device as in FIG. 10, shown without the use of a counterweight;

FIG. 14 is an expanded fragmentary view of a lid-half of the device of FIGS. 5 & 6 having the handle detached showing the detail of the hinge mechanism and the handle lug and tab, and showing part of one of the closure mechanisms in phantom lines;

FIG. 15 is an expanded fragmentary side view of the hinge mechanism of FIG. 1;

FIG. 16 is an enlarged view of the detachable handle of the preferred embodiment of the device which has been detached from the container of the device of FIG. 1;

FIG. 17 is an expanded fragmentary interior perspective view of FIG. 1, showing a closure member in one of the lid-halves;

FIG. 18, is an expanded fragmentary section view through a portion of the bumper of FIG. 17 along section line 18—18 and illustrating the T-bar construction of the bumper;

FIG. 19 is an expanded fragmentary interior perspective view of a lid-half showing an alternative embodiment closure member; and FIG. 20, is an fragmentary section view taken through a portion of the bumper of FIG. 19 along section line 20—20 and illustrating the rectangular edge profile construction of the bumper;

FIG. 21A is a schematic broken away cross-sectional view of the device of FIG. 1 taken through section line 8—8 of FIG. 7 showing manual opening of the lid-halves of the device by depressing the tabs downwardly;

FIG. 21B is a schematic broken away cross-sectional view of the device of FIG. 1 taken through section line 8—8 of FIG. 7 showing the mechanical closing of the device using a toilet plunger;

FIG. 21C is a schematic broken away cross-sectional view of the device of FIG. 1 taken through section line 8—8 of FIG. 7 showing a toilet plunger in the stored position and showing fluids draining off the toilet plunger and into the grooves in the base;

FIG. 21D is a schematic broken away cross-sectional view of the device of FIG. 1 taken through section line 8—8 of FIG. 7 showing the mechanical opening of the device using a toilet plunger;

FIG. 21E is a schematic view of the device of FIG. 21B without the toilet plunger showing the pouring of cleaning solution into the open device of the present invention;

FIG. 21F is a schematic view of the device of FIG. 21B showing the closing of the device, which has cleaning solution therein, using the toilet plunger;

FIG. 21G is a schematic view of the device of FIG. 21B showing the device with the toilet plunger soaking in the cleaning solution; and FIG. 21H is a side view of the device of FIG. 1, illustrating gripping the device by the user to drain the device.

DETAILED DESCRIPTION OF THE INVENTION

The present invention relates broadly to bathroom accessories and in particular, to bathroom accessory storage devices for toilet plungers. However, the present invention is most particularly adapted for use in storing and cleaning a toilet plunger. Accordingly, the present invention will now be described in detail with respect to such endeavors; however, those skilled in the art will appreciate that such a description of the invention is meant to be exemplary only and should not be viewed as limitative on the full scope thereof.

The device of the present invention advantageously permits the user to open and close the device using a toilet plunger without the user touching the soiled plunger cup or the interior of the device. The device of the present invention also permits a wet toilet plunger to drain inside the device, advantageously preventing drainage on the bathroom floor. The drainage is collected within the device and is drained from the device via a pour spout. The device of the present invention is also resistant to tipping when the toilet plunger is removed or inserted into the device as well as when the device is stored, either empty or with a toilet plunger in the device.

The preferred exemplary embodiment of the present invention will hereinafter be described in conjunction with the appended drawing wherein like designations refer to like elements throughout. Reference is initially made to FIGS. 1–21H depicting a bathroom accessory, specifically, a device 10 for storing and cleaning a toilet plunger according to the present invention.

A conventional toilet plunger 12 has a cup 14 and a handle 16. The toilet plunger handle has two opposite ends. The cup 14 is disposed at one of the ends of the handle 16 with the other opposite end being available for manipulation by the user. The toilet plunger cup 14 has a plunger cup side wall 18 which terminates in a cup end wall 20. The toilet plunger cup 14 has a cup outer diameter 19 and an end wall diameter 21. The cup outer diameter 19 and the end wall diameter 21 may be identical in dimension as illustrated in FIG. 11, or the end wall diameter 21 may be smaller than the cup outer diameter 19 as shown in FIGS. 21B–21D and 21F–21G, as is known in the toilet plunger art. The toilet plunger has an overall length which is measured by a distance extending from the cup end wall 20 to the end of the handle 16 which is available for manipulation by the user.

The device 10 includes an open-topped container 22 and an upper lid 24 resting on and covering the open-topped container 22. The lid 24 has two lid-halves 25. The container 22 is suitably dimensioned to be a plunger-receiving container with the plunger 12 resting within the container 22 and with a protruding portion 15 of the plunger handle 16 protruding through the lid 24, as illustrated in FIGS. 11, 21C and 21G.

The device 10 of the present invention is suitably made of plastic materials, such as, but not limited to high impact co-polymer polypropylene, using an injection mold process. However, the device 10 may also be made of a variety of other plastics or metals. Most preferably the lid 24 and container 22 are made of high impact co-polymer polypropylene, available from Solvay Corp., of Houston, Tex.

The open-topped container 22 has a base 26 having upstanding container side walls 28 which terminate in an upper perimeter wall edge 30 which forms an opening 31 of the open-topped container 22. The container walls 28 have a wall thickness 27. The container 22 has an interior 29 formed by the container walls 28 and the base 26. The device 10 has an interior 32 formed by the lid 24, the container walls 28 and the base 26. The base 26 has a base top 35 with a top surface 36, an opposite base bottom 33 with a bottom surface 38 and a base peripheral edge 39. The base top surface 36 and the base bottom surface 38 are opposing. The base has a base thickness 37, i.e., the dimension between the top surface 36 and the bottom surface 38. The base top surface 36 is oriented toward the interior 29 of the container 22. The base 26 also has a lower peripheral rim 40 which extends downwardly from the base 26 and is integral with the upstanding walls 28.

As best shown in FIGS. 8A, 8B and, 10–12A, 13, 21A–21G, the base top 35 of base 26 has a plurality of base grooves 42 therein. The grooves 42 are disposed downwardly away from the opening 31 of the open-topped container 22. Between the grooves 42 are base flat portions 43. Each of the base flat portions 43 are preferably elongated in shape with curved ends, although other shapes may be used. As best shown in FIGS. 11, 21C and 21G, the base flat portions 43 form the generally flat base top 35 which advantageously provides a stable surface for the cup end wall 20 of the toilet plunger 12 to rest upon. The base 26 has a front portion and a back portion. Advantageously, any fluids 44 draining off the toilet plunger cup 14 may be collected in the grooves 42. The grooves 42 all connect at the front portion and the back portion of the base 26, so that fluids 44 will pool there and readily drain to the front of the device 10 and out of a pour spout 80 when the device 10 is tipped for pouring. The opposite bottom surface 38 of the base 26 is preferably flat.

Figure 2:
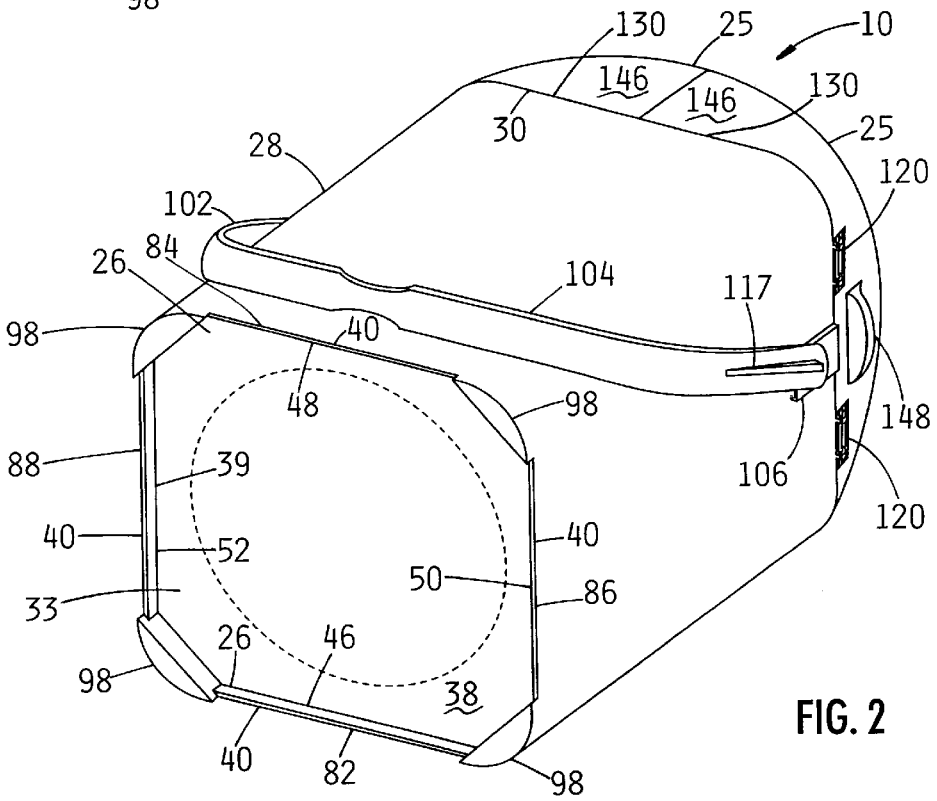
FIG. 2 is a bottom perspective view of the rear and side device of FIG. 1 with phantom lines showing the position of the counterweight.

Preferably, a counterweight 45 is disposed in the device 10 under the top surface 36 and below grooves 42. FIG. 2 is a bottom perspective view of the device of FIG. 1, with the counterweight shown in phantom lines to illustrate the position of the counterweight in the base 26. The counterweight is preferably molded into the device when the device 10 is injection molded and is preferably disposed between the top surface 36 and the bottom surface 38 of the base 26. The counterweight 45 advantageously prevents tipping of the device 10 when the toilet plunger 12 is removed from the device 10, when the device 10 is used to store the toilet plunger 12 and when the device 10 is empty. The counterweight 45 is suitably approximately 1 to 1.5 pounds (454 to 681 grams) in mass and is made of materials, such as, but not limited to, anodized steel, granite, marble, marble-like plastics such as CORIAN™ (commercially available from DuPont of Wilmington, Del.). The counterweight 45 is preferably a one pound circular sheet of ⅛ inch anodized steel, commercially available from Exel Tool & Molding of Elroy, Wis.

Alternatively, as shown in FIGS. 12A and 12B, the counterweight 45 may be affixed to a recess 37 in the bottom surface 38 of the base 26 of the device 10 in a conventional matter, such as by gluing, cementing, sonic welding, etc. The recess 37 is suitably dimensioned to accept the counterweight 45. The counterweight 45 is affixed to the base 26 by applying a layer 47 of adhesive, preferably a water proof cement, such as 3M ALL PURPOSE INDUSTRIAL ADHESIVE, commercially available from 3M Corp. of St. Paul, Minn. to the recess 37 and then placing the counterweight 45 onto the adhesive layer 47. Still, alternatively, the device 10 may be manufactured and used without a counterweight as shown in FIG. 13. All other aspects of the invention, as shown in FIGS. 12A–12B and 13, are identical to the preferred embodiment as shown and described in FIG. 1.

To better illustrate the base 26 and upstanding walls 28, reference is made to FIGS. 2–6, 8A, 8B and 9. The base 26 is preferably generally square in shape having curved corners. Thus, the base peripheral edge 39 has four linear sides (base front side 46, base rear side 48, base left side 50 and base right side 52) and four curved base corners 54, 56, 58, 60. A curved base corner is disposed between each pair of linear base sides. Walls 28 extend upwardly from the base sides 46, 48, 50, 52 and curved base corners 54, 56, 58, 60 of the base peripheral edge 39 and are integral with each other and with the base 26. Thus, a front wall 46' extends from base front side 46; a rear wall 48' extends from base rear side 48; a left side wall 50' extends from base left side 50; a right side wall 52' extends from right side wall 52; and curved corner walls 54', 56', 58', and 60' extend from base curved corners 54, 56, 58 and 60, respectively. Collectively, container walls 46', 48', 50', 52' 54', 56', 58', 60' are referred to as walls 28. The upper perimeter wall edge 30 of the walls 28 generally repeat the shape of the base 26, having linear upper perimeter side portions (front 62, rear 64, left 66, and right 68) interconnected by four curved upper perimeter corner portions 70, 72, 74, 76. Upper perimeter front side portion 62 has a perimeter projection 78 for a pour spout 80, as best illustrated in FIG. 8B, and described in detail hereinafter. Advantageously, the preferred curved corner walls 54', 56', 58', 60' make the device easier to clean because there are no sharp angled corner walls to which semi-solid materials from a soiled plunger may adhere.

The lower peripheral rim 40 extends downwardly from the base peripheral edge 39 and away from the opening 31 of container 22. Rim 40 is integral and continuous with walls 28. The rim 40 has four linear sides (rim front side 82, rim rear side 84, rim left side 86, rim right side 88) and four curved rim corners 90, 92, 94, and 96. A rim corner is disposed between each pair of linear rim sides. Feet 98 extend from the rim 40 at each of the curved rim corners 90, 92, 94, and 96 of the base 26. The feet 98 provide additional stability to the container 22 and elevate the rim 40 of the container 22 above a surface (not shown) upon which the device 10 is placed, advantageously providing air circulation under the device 10 to diminish any moisture accumulation there.

Figure 3:
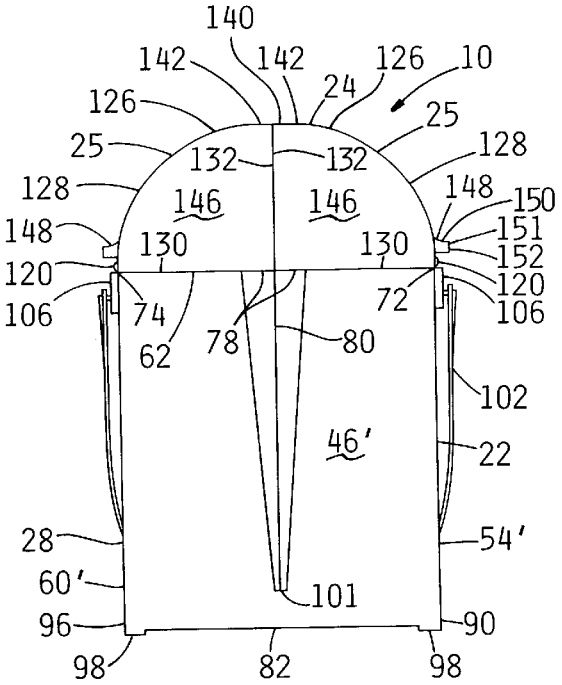
FIG. 3 is a front view of the device of FIG. 1.
Figure 4:
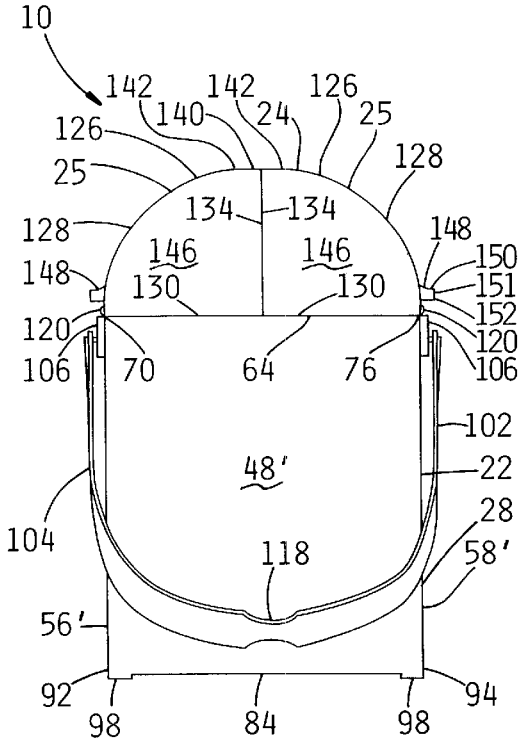
FIG. 4 is a rear view of the device of FIG. 1.

Moving upwardly toward the opening 31 of the container 22, as best shown in FIGS. 1, 3 and 11, the walls 28 of the container 22 have a spout portion projecting outwardly from the front wall 46' defining the aforementioned pour spout 80. The pour spout 80 has an upper edge 99 preferably located at the upper perimeter wall edge 30 of the opening 31 of open-topped container 22. Pour spout 80 has a lower edge 101 integral with and intersecting base 26. The pour spout 80 is useful for draining fluids 44 or cleaning solutions 81 from the device 10. After the device 10 has been drained of fluids 44 or solutions 81, the pour spout 80 also allows for entry and circulation of air into the device 10 to aid in drying the device 10 and/or the toilet plunger 12 stored in the device 10.

A handle 102 is attached to the walls 28 of the container 22 below the upper perimeter wall edge 30 in a conventional manner using handle lugs. Preferably, the handle 102 is a detachable handle 104 which may be removed from the container 22. Reference is now made to FIGS. 14 and 16, which illustrate the preferred use of the detachable handle 104 for use with the device 10. A pair of handle lugs 106 are disposed on the container 22 near the container opening 31, with one handle lug 106 of the pair respectively on the left side wall 50' and the other handle lug 106 on the right side wall 52'. FIG. 14 is an expanded fragmentary view showing the detail of one of the handle lugs 106 of the device 10 with the detachable handle 104 detached from the device 10. Each handle lug 106 has a key hole opening 108 for accepting a handle pin 110. The key hole opening 108 has a top 107 and a bottom portion 109. FIG. 16 is a view of the detachable handle 104 of the preferred embodiment of the device 10 and is shown detached from the container 22 of the device 10. The detachable handle 104 has a central portion 112 located between two end portions 114, 116. Each handle pin 110 has a groove 115 suitably dimensioned to fit into key-hole opening 108 of handle lug 106. A triangular-shaped reinforcement 117 is disposed on each end portion 114, 116 behind each handle pin 110. One handle pin 110 is affixed to each end portion 114, 116. The central portion 112 of the detachable handle 104 has an hourglass shaped curved center waist portion 118 to facilitate the resting of the handle 102 against the handle 16 of the plunger 12 when the user is carrying the device 10 or when the user is pouring fluids 44 or cleaning solutions 81 from the device 10. The detachable handle is made of a flexible, strong material, such as, but not limited to a variety of plastics and metals and is preferably made of polypropylene or polyethylene plastics, commercially available from the Solvay Corp. of Houston, Tex.

The detachable handle 104 may be removed when the device 10 is cleaned and reattached afterward. The two lid-halves 25 are held secure by the detachable handle 104 when the detachable handle 104 is raised into an upright position as occurs when the device 10 is being carried.

Also located near the opening 31 of the container 22 is the hinge mechanism 120. Preferably each lid-half 25 is attached to the container by a pair of hinge mechanisms 120 permitting each lid-half 25 to pivotly open outside the container 22 without telescoping on the container 22 and without telescoping on the other lid-half 25. Suitable hinge mechanisms 120 include, but are not limited to commercially available metal strap hinges or plastic self-hinges. These hinge mechanisms 120 may be affixed to the container by rivets, screws, bolts, or suitable commercially available adhesive, or may be integral with the container as is known in the art.

As best shown in FIG. 14, the preferred hinge mechanism 120 of the device 10 has three parts, a pair of hinge cylinders 122, and a hinge pin 124. The hinge mechanism 120 is designed so that the lid-halves 25 may be easily removed for cleaning, if desired. Each hinge cylinder 122 is suitably a C-shaped cylindrical projection of the container 22 extending upwardly from the upper perimeter side portion of a side wall, e.g., from upper perimeter left side portion 66 on left side wall 50', extending upwardly from upper perimeter right side portion 68 on right side wall 52' of the open-topped container 22. As best shown in FIG. 15, where FIG. 15 is an expanded fragmentary side view of the hinge mechanism of FIG. 1, the hinge pin 124 is suitably a solid cylinder in shape and dimensioned to snap into and rotatingly fit within an open interior portion 129 of the C-shaped cylindrical projection. The hinge pin 124 is preferably an integral part of the lid-half 25 and is flanked by rectangular opening 121 and rectangular cut out 123 on the lid-half 25. The lid-half 25 is easily removed by forcing each hinge pin 124 out of its pair of respective C-shaped hinge cylinders 122.

The upper lid 24 and an internal closure mechanism 125 of the preferred embodiment will now be described. Preferably, the upper lid 24 is curved, and has two lid-halves 25 of the curved clam-shell type which are mirror-images of each other, hence the same numbering will be used for the same corresponding elements of each lid-half 25. As used herein throughout, the term "mirror-images" is meant to refer to elements that are structurally alike, but are reversed in handedness.

Upper lid 24 has a lid thickness 127. Each curved lid-half 25 has a curved lid-half top 126 and lid-half side walls 128 extending from the lid-half top 126 and terminating in an arch shaped lid-half lower edge 130 and in curved front closure edges 132 and curved rear closure edges 134. When the curved lid 24 is closed, the curved lid-halves 25 abut each other, with the curved front closure edges 132 of one lid-half 25 contacting the curved front closure edges 132 of the other lid-half 25 above the front wall 46' of the container 22 and with the curved rear closure edges 134 of one lid-half 25 abutting the curved rear closure edges 134 of the other lid-half 25 and above the rear wall 48' of the container 22. The pair of lid-half lower edges 130 rest on the upper perimeter wall edge portions 64, 66, 68, 70, 72, 74, 76 and 62 except for the perimeter projection 78, defining the pour spout 80. The lid thickness 127 and container wall thickness 27 are preferably approximately equal in dimension.

The curved lid 24 has a portion defining a hole 140 with hole edges 142. The hole 140 is of sufficient dimension to permit a toilet plunger handle 16 to penetrate the hole 140 and to move freely through the hole 140. This means that the hole 140 must at least accommodate the circular cross-sectional area of the handle of the toilet plunger 12. The hole 140 penetrates the top 126 both of the lid-halves 25. Preferably, the hole 140 in the lid 24 is circular in area with the area equally apportioned between the curved lid-halves 25 and continuous between the curved lid-halves 25, penetrating both curved lid-half tops 126 when the upper lid 24 is closed. Preferably, the largest diameter dimension of the hole 140 is determined by multiplying the largest diameter of handle 16 of commercially available toilet plunger 12 by a factor of 1.5. This dimension is sufficient to allow easy closure of the lid-halves 25 and advantageously to provide for air circulation within the device 10.

Each curved lid-half 25 has an interior surface 144 and an opposite exterior surface 146. Advantageously, the lid may be opened from outside the device 10, without touching the interior surface 144 of the lid-halves 25. The upper lid 24 also has a pair of tabs 148, with one of each of the pair of tabs 148 on the exterior surface 146 of each lid-half 25 near the lid-half lower edge 130. A tab 148 extends outwardly from the exterior surface 146 of each lid-half 25 near the lid-half lower edge 130 and above the handle 102. The tabs 148 have a curved upper portion 150, a radiused side wall 151 and an opposing edge portion 152. The curved upper portion 150 of tab 148 may be pressed downward by the user to manually open the lid-halves 25. The angled end portion 152 then pivots downwardly and is stopped in travel by the handle lug 106. This prevents the further travel of the lid-half 25.

An internal closure mechanism 125 is disposed within the lid-halves 25 and advantageously closes and opens the device 10 from within using toilet plunger 12 itself. Referring additionally to FIGS. 8A, 8B, 10–12A, 13, and 17–21G, the internal closure mechanism 125 comprises a pair of mirror-imaged closure members 154, hence the same numbering will be used for corresponding elements of each closure member 154. One of each of the pair of closure members 154 is integral with and extends from the interior surface 144 of each lid-half side wall 128 into the interior 32 of the device 20. As best illustrated in FIGS. 8A and 8B each closure member 154 approximately bisects the curved lid-half 25 and is located with a first end 156 adjacent the edge 142 of hole 140 and a second end 157 near lid-half lower edge 130.

Each closure member 154 of the internal closure mechanism 125 has two sections which are integral with each other. The first section is a bumper 158 and the second section is a lever 160. The bumper 158 is a curved member for engaging the side wall 18 of the cup 14 of the toilet plunger 12. The bumper 158 has a D-shaped curve portion 170 directly adjacent to an inwardly bent section 172. The D-shaped curve portion 170 has a radius dimension. The lever 160 is a linear member for engaging the end wall of the cup 14 of the toilet plunger 12. The lever 160 has a generally truncated triangular shape with a first side 176, an opposite second side 178 and a third side 180 connecting the first side 176 and second side 178. The second side 178 and the third side 180 of lever 160 are spaced from the interior surface 144 of the lid-half 25. As best shown in FIGS. 10 and 11, the second side 178 of lever 160 extends approximately parallel to a side wall of the container 22 when the lid-halves 25 are closed. As best shown in FIGS. 17 and 18, the two equal side flanges 182, extend outwardly at approximately 90° angles from D-shaped curve portion 170, inwardly bent section 172 and first side 176, and are continuous forming a closure member peripheral edge surface 184. The side flanges 182 in co-operation with the D-shaped curved portion 170, the inwardly bent portion 172 and the first side 176 form a T-bar construction when the bumper 158 and the lever 160 are viewed in cross-section, as illustrated in FIGS. 8B, 17 and 18. The T-bar construction of bumper 158 and lever 160 provides exceptional cross-sectional strength at minimum weight and material usage.

The closure member peripheral edge surface 184 has a curved peripheral portion 187 corresponding to the D-shaped curved portion of the bumper 158 and a linear peripheral portion 188 corresponding to first side 176. The curved peripheral portion 187 of the bumper 158 is suitably dimensioned to engage the plunger cup side wall 18 of the toilet plunger 12 when the plunger 12 is pulled out of the closed device 10. The linear peripheral portion 188 of the lever 160 is suitably dimensioned for engaging the cup end wall 20 of the toilet plunger 12 when the lid-halves 25 are in the fully open position. As best illustrated in FIG. 10, the largest spacing L between the linear portions 188 of the pair of levers is dimensioned to exceed the largest dimension of the cup outer diameter 19 of the plunger cup 14 of the toilet plunger 12, when the lid-halves 25 are in the closed position.

The radius dimension of the D-shaped curve portion 170 of bumper 158 is such that when the plunger 12 is pulled from the device 10, the plunger cup side wall 18 will force the curved lid-half 25 to open to a point such that the lower edge 130 of the lid-half 25 swings past the vertical. In this position, the curved lid-half 25 will then fall under the influence of gravity into its most open position where the angled end portion 152 of tab 148 stops the travel of the lid by resting against the handle 102 or handle lug 106. This is best shown in FIG. 21B.

The length of the lever 160 is such that when the curved lid-halves 25 are open, the distance M, as seen on FIG. 21B, between the end sides 180 of the levers 160 is less than the smallest dimension of the cup end wall diameter 21 of the cup end wall 20 of a conventional toilet plunger 12.

Alternatively, as shown in FIG. 19, the structure of the internal closure mechanism 125 is suitably modified by removing only the two equal side flanges 182 from the closure member 154 to show a second embodiment of the closure member 154'. The curved peripheral portion 187 of the bumper 158 defines a perimeter 194 of the D-Shaped curved portion 170 of the bumper 158 and the linear peripheral portion 188 of the lever 160 defines a perimeter 196 of first side 176. Without the presence of the flanges 182, a rectangular edge profile is created. As best illustrated in FIGS. 19 and 20, a rectangular edge profile is observed when the internal closure mechanism of this alternative embodiment of the internal closure mechanism is viewed in cross-section. All other elements of the invention utilizing the alternate closure member 154' are as described herein throughout.

As best illustrated in FIGS. 11, 21C and 21G, the container 22 and the lid 24 are dimensioned for enclosing both the plunger cup 14 of the toilet plunger 12 and an enclosed portion 200 of the handle 16 of the toilet plunger 12. The remainder protruding portion 15 of the toilet plunger handle 16 protrudes through the hole 140 in the lid 24. Preferably, device 10 has the following dimensions to accommodate a plunger 12 having a cup diameter of about 14 cm (five and one-half inches).

In one conventional toilet plunger style as shown in FIG. 11, cup 14 outer diameter 19 at its widest portion is the same as end wall diameter 21; this dimension is about 14 cm (5½ inches). The plunger handle 16 extends about 45.7 cm (18 inches) above the cup 14 with the overall toilet plunger length about 55.9 cm (22 inches). In another conventional toilet plunger style (as shown in FIGS. 21B–21D, 21F, 21G) plunger cup outer diameter 19 at its widest portion is about 14 cm (5½ inches) and end wall diameter 21 is about 9.5 cm (3¾ inches). Plunger handle 16 extends about 45.7 cm (18 inches) above the cup 14 with the overall toilet plunger length about 60.3 cm (23¾ inches).

In its current configuration, to accommodate either of the plunger styles shown in FIG. 11 or FIGS. 21B–21D, 21F, 21G, the preferred overall height of device 10 is about 30.5 cm (12 inches); the height of container 22 is about 21 cm (8¼ inches) the radius of the curved upper lid 24 is about 9.5 cm (3¾ inches). The distance from exterior wall 46' to exterior wall 48' is about 19 cm (7½ inches) and about 19 cm (7½ inches) from exterior wall 50' to exterior wall 52'. Curved corners 54, 56, 58, 60, 54', 56', 58', and 60' of device 10 each have an external radius of about 3.2 cm (1¼ inches). The lower peripheral rim 40 of base 26 is about 1.6 cm (⅝ inches) in depth. Feet 98 extend below the lower edge of rim 40 for a distance of about 0.3 cm (⅛ inch). The counterweight is about 15.2 cm (6 inches) in diameter. The thickness of the counterweight is dependent upon the mass of material of its construction; preferably when it is made of anodized steel, it is about 0.3 cm (⅛ inch) thick. The parallel grooves 42 in the top surface of the base 26 have a radius of about 0.6 cm (¼ inch) and are separated by about 1.3 cm (½ inch) wide flat base portions 43. The pour spout 80 is about 3.8 cm (1½ inches) wide across upper edge 99 of upper perimeter wall edge 30 of the wall 46' and tapers to about 1.3 cm (½ inches) wide across lower edge 101; the pour spout 80 extends about 1.9 cm (¾ inch) outwardly at upper edge 99 and tapers inwardly as it extends downwardly until it is even with the wall 46' at the base 26. Handle lugs 106 are about 1.9 cm (¾ inch) wide and about 2.5 cm (1 inch) tall. The top portion 107 of the key-hole opening 108 in the handle lug 106 has a radius of about 0.2 cm (5/64 inch). The detachable handle 104 is about 50.8 cm (20 inches) in length, 1.9 cm (¾ inch) in width, and 0.25 cm (0.10 inch) thick; the hour-glass shaped waist 118 at the center 112 of the length of detachable handle 104 has the radius of curvature of about a 3.8 cm (1½ inch), 20° ellipse. The handle pin 110 of detachable handle 104 is about 0.4 cm (5/32 inch) long and about 0.6 cm (¼ inch) in diameter; the groove 115 is about 0.2 cm (1/16 inch) wide and about 0.2 cm (1/16 inch) deep and disposed at the handle pin 110. Groove 115 fits into the top portion 107 of the key-hole opening 108 of handle lug 106. The triangular-shaped reinforcement 117 is about 5.1 cm (2 inches) long and about 0.5 cm (3/16 inch) wide at its base and on the surface of detachable handle 104 directly opposite handle pin 110. Hinge pins 126 are preferably an integral part of lid-halves 25. Each hinge pin 124 is about 2.9 cm (1⅛ inch) long and about 0.1 cm (3/64 inch) in diameter. The C-shaped hinge cylinders 122 are an integral part of the walls 50' and 52' of container 22 and have an inside diameter of about 0.2 cm (1/16 inch). The open interior portion 129 of the C is about 0.1 cm (1/32 inch). The lid 24 has an external radius of about 9.5 cm (3¾ inches). Lower lid edge 130 conforms in shape and dimensions to the upper perimeter wall edge 30 of container 22, except for the perimeter projection 78, defining the pour spout 80. Wall thickness of the device 10 is preferably 0.25 cm (0.10 inches). Thus the lid 24 and the wall 28 of the container 22 each have the same thickness of 0.25 cm (0.10 inches). Thus, lid thickness 127, container wall and lid thickness 127 are preferably equal in thickness. The hole 140 in the top of the lid 24 is about 3.8 cm (1½ inches) in diameter. The D-shaped curved portion 170 of each closure member 154 has a radius of about 3.2 cm (1¼ inch). Inwardly bent section 172 has a radius of about 0.6 cm (¼ inch). The portion 170 begins about 1.3 cm (½ inch) from the hole edges 142. The lever portion 160 of closure member 154 is about 10.2 cm (4 inches) in length. The spacing L is about 15.6 cm (6⅛ inches). The distance M is about 5.1 cm (2 inches). The width of the thumb tab 148 is about 4.5 cm (1¾ inches); it extends outwardly from the external surface 146 of the lid-half 25 for about 1 cm (⅜ inch), and its outer edge has the curvature of a 3.8 cm (1½ inch) 30° ellipse. As is appreciated by those skilled in the art, the device may be dimensioned appropriately to accommodate different sized toilet plungers.

The method of use of the present invention for opening and closing the device using the toilet plunger will now be described. FIGS. 21A–21H illustrate the methods of using i.e., the operation of device 10 of the present invention for storing and cleaning a toilet plunger 12. FIGS. 21A–21D illustrate the method of opening and closing the device 10 using the toilet plunger 12. FIGS. 21A–21G utilize the cross-sectional view of FIG. 13; thus the views look into the interior 32 of the device 10 toward the rear wall 48' of the device 10. FIG. 21H is a side view of the device.

As best shown in FIG. 21A, the present invention is used in the following way to load a toilet plunger 12 into the device 10 when the lid-halves are closed. The tabs 148 on the lid-halves 25 are depressed downwardly by the user preferably with the user's thumbs. Downward arrows on FIG. 21A illustrate the downward movement of the tabs 148; the curved arrows illustrate the travel of the lid-halves 25 to the fully open position. The downward pressure on the tabs 148 causes the lid-halves 25 to pivot away from each other and to open the lid-halves 25 exposing the interior 29 of the container 22, as shown in FIG. 21B. Each lid-half 25 travels sidewards and downwardly until the tab 148 rests on the handle 102 or handle lug 106 of the container 22 of the device 10.

FIG. 21B also illustrates how the plunger 12 is lowered with the plunger cup 14 oriented downwardly into the open lid-halves 25 and into contact with the levers 160. The downward arrow illustrates the downward movement of the toilet plunger 12. When the cup end wall 20 of the plunger 12 contacts the linear peripheral portions 188 of the levers 160, the user continues to lower the plunger 12 downwardly, whereby the cup end wall 20 presses downwardly onto the levers 160 of the internal closure mechanism 125 of the lid-halves 25, thereby causing the lid-halves 25 to pivot upwardly, as illustrated by the upwardly curving arrows, to close the container 22 with the lid-half closure edges 132, 134 of one lid-half 25 abutting the corresponding closure edges 132, 134, on the other lid-half 25.

The plunger 12 is further lowered by the user to permit the plunger cup end wall 20 to rest upon the base 26 as best shown in FIG. 21C. If the device 10 is used for storing the toilet plunger 12 at this time, any fluids 44 adhering to the plunger cup 14 drain into the grooves 42 in the base 26. If the fluid amount is minimal, e.g., the grooves 42 are not filled with fluid 44, the plunger cup 12 is dried by the air circulation through the pour spout 80, lid hole 140 and grooves 42. If the fluid 44 fills the grooves 42, the user can drain the device 10, as will be explained hereinafter in association with FIG. 21H.

To remove the toilet plunger 12 from the device 10, it is only necessary for the user to grasp the remainder protruding portion 15 of the plunger handle 16 and to pull the plunger 12 upwardly and out of the device 10, as illustrated in FIG. 21D. Upward arrows illustrate the upward movement of the toilet plunger 12. The upward movement of the plunger 12 causes the plunger cup side wall 18 to contact the curved peripheral portions 187 of the pair of bumpers 158 in the lid-halves 25, causing the lid-halves 25 to pivot open. Advantageously, the user never has to touch the soiled toilet plunger 12 or any parts inside the device 10 to load or to remove the toilet plunger 12, thus minimizing the possibility of bacterial contamination of the user. Most advantageously, the counterweight 45 provides additional stability to the device 10 during this step, maintaining the device 10 in an upright position while the plunger 12 is being pulled out of the device 10.

FIGS. 21A, 21E–21H illustrate the present method of cleaning a toilet plunger in the device 10 of the present invention. If the device 10 is used for cleaning the toilet plunger 12, the device 10 may be opened by the user by depressing the tabs 148 on the lid-halves 25 with the user's thumbs, as previously explained herein and illustrated in FIG. 21A.

As shown in FIG. 21E, sufficient quantities of cleaning solutions 81 are poured into the container 22. Typically, the cleaning solution is in a quantity sufficient to cover any soiled parts of the toilet plunger. The cleaning solution may be a commercially available household cleaning product or a soap or detergent and water mixture, or a bleach and water mixture, or a disinfectant solution, or water, or safe mixtures thereof, e.g. combinations of the preceding which do not pose a health problem to the user.

As is best illustrated in FIG. 21F, the toilet plunger 12 is inserted orienting the plunger cup 14 downwardly into the interior 29 of the container 22 as previously discussed in conjunction with FIG. 21B, thereby closing the device 10. Again the downward arrows illustrate the downward force by the plunger cup 14 on the levers 160 of the internal closure mechanism 125, thereby causing the upward rotation of the lid halves 25 (as shown by the curved upward arrows) to close the container 22 of the device 10.

As best illustrated in FIG. 21G, the toilet plunger is allowed to soak in the cleaning solution 81 for an appropriate time period to clean it.

If the fluid 44 fills the grooves 42, or if cleaning solution 81 is in the device 10, the user can drain the device 10, as best illustrated in FIG. 21H, by grasping the rim 40 with the fingers of one hand while holding the handle 102 in the other hand and tilting the device 10 sufficiently to permit the drainage 91, e.g., fluids 44 and/or cleaning solution 81 to drain out of the device 10 via the pour spout 80. Advantageously, the user avoids contact with the drainage 91 since the user does not have to touch the inside of the device 10 or the toilet plunger 12, thereby avoiding contact with possible bacterial contamination and/or harsh or messy cleaning solution.

The toilet plunger 12 may be removed from the device 10 by pulling the plunger handle 16 upwardly out of the device 10 as previously explained and illustrated in FIG. 21D. When device 10 is carried, the two lid-halves 25 are held secure by detachable handle 104, as is also illustrated in FIG. 21H.

While the present invention has now been described and exemplified with some specificity, those skilled in the art will appreciate the various modifications, including variations, additions, and omissions, that may be made in what has been described. Accordingly, it is intended that these modifications also be encompassed by the present invention and that the scope of the present invention be limited solely by the broadest interpretation that lawfully can be accorded the appended claims.

What is claimed is:

1. A device for storing and cleaning a toilet plunger having a handle and a cup disposed at one end thereof, the cup having a side wall terminating in a cup end wall, said device, comprising:

(a) an open-topped plunger-receiving container;

(b) a lid comprising two lid-halves, each said lid-half having an interior surface and an exterior surface, said lid having a hole herethrough, said hole penetrating said two lid-halves;

(c) a hinge mechanism connecting each said lid-half to said container; and (d) an internal closure mechanism disposed within said lid and extending from said interior surface of each said lid half into said device, and adjacent said hole, said internal closure mechanism comprising a curved member for engaging the side wall of the cup of the toilet plunger and a linear member for engaging the end wall of the cup of the toilet plunger.

2. The device of claim 1, wherein said container has a base having upstanding side walls, said base having a base top with a top surface and an opposing bottom surface, said base top having a groove.

3. The device of claim 2, wherein said container further comprises a counterweight disposed within said base.

4. The device of claim 2, wherein said base bottom surface has a recess therein and said container further comprises a counterweight affixed to said bottom surface of said base and disposed in said recess.

5. The device of claim 2, wherein said side walls have a spout portion defining a pour spout.

6. The device of claim 1, wherein said container and said lid are dimensioned for enclosing both the cup of the toilet plunger and a portion of the handle of the toilet plunger and wherein when the plunger is in the container a remainder of the handle protrudes through said hole in said lid.

7. A device for storing and cleaning a toilet plunger having a handle with opposed ends and a cup disposed at one end thereof, the cup having a side wall terminating in a cup end wall, said device comprising (a) a container;

(b) a curved lid having two curved lid-halves said lid having a hole therethrough, said hole penetrating said lid-halves;

(c) means for pivotly connecting each said lid-half to said container, said means permitting said lid-halves to open outside said container without telescoping on said container and without telescoping on each other; and (d) means for closing and opening said lid-halves using the toilet plunger.

8. The device of claim 7, wherein each said lid-half has an interior surface and an exterior surface, and wherein said means for both closing and opening said lid-halves is a pair of mirror-imaged closure members, one of each said closure members projecting from one said interior surface of one of each said lid-halves into said device.

9. The device of claim 8, wherein said closure member has a D-shaped curved portion for engaging the side wall of the cup of the toilet plunger, and for opening said lid-halves and wherein said closure member has a linear portion adjoining said D-shaped curved portion, said linear portion for engaging the end wall of the cup of the toilet plunger and for closing said lid-halves.

10. The device of claim 7, wherein said container has a base having upstanding side walls, said base having a base top with a top surface and an opposing bottom surface, said base top having a portion defining a groove.

11. The device of claim 10, wherein said container further comprises a counterweight spaced from said base top surface and under said groove.

12. The device of claim 10, wherein said side walls have a spout portion defining a pour spout.

13. A device for storing and cleaning a toilet plunger having a handle with opposed ends and a cup disposed at one end thereof, the cup having a side wall terminating in a cup end wall, said device comprising:

(a) an open-topped container, said container having a base having upstanding side walls, a base top with a top surface and a base bottom with an opposing bottom surface, said base top having a plurality of base top grooves and said side walls having a spout portion defining a pouring spout;

(b) a curved lid having two curved lid-halves, each lid-half having an interior surface and an exterior surface, said lid having a hole therethrough, said hole penetrating said two lid-halves;

(c) a hinge mechanism connecting each said lid-half to said container; and (d) a pair of closure members, each closure member projecting from said interior surface of said lid-half; each said closure member having a bumper and a lever with said bumper adjacent said hole, said bumper having a D-shaped curve portion and an inwardly bent section, with said D-shaped curved section directly adjacent to said inwardly bent section, and said lever having a truncated triangular shape with a first side, an opposite second side and a third side connecting said first side and said second side, with said first side continuous with said inwardly bent section of said bumper.

14. The device of claim 13, wherein said closure member further comprises a flange extending perpendicularly from said closure member providing each said bumper and each said lever with a T-bar cross-section shape.

15. The device of claim 13, wherein said closure member has a rectangular cross-section.

16. The device of claim 13, wherein said D-shaped curved portion of said bumper is suitably dimensioned for engaging the side wall of the cup of the toilet plunger and wherein said first side of said lever is suitably dimensioned for engaging the end wall of the plunger cup of the toilet plunger.

17. The device of claim 13, wherein said container further comprises a counterweight spaced from said top surface and under said base top grooves.

18. The device of claim 13, wherein said container and said lid are dimensioned for enclosing both the cup of the toilet plunger and a portion of the handle of the toilet plunger and wherein a remainder of the handle protrudes through said hole in said lid when the toilet plunger is in the container.

19. The device of claim 13, further comprising a detachable handle releasably affixed to said container.

20. The device of claim 13, wherein each said lid-half has an outwardly projecting tab on said exterior surface, said tab disposed proximate said hinge mechanism.

21. A method for opening and closing a toilet plunger storing and cleaning device, using a toilet plunger having a handle with opposed end, and a cup disposed at one end thereof and having a sidewall terminating in a cup end wall, said method comprising the steps of:

(a) opening a device having (i) an open-topped container having an interior, (ii) a lid thereto having two lid-halves and a hole therethrough, (iii) a hinge mechanism connecting each said lid-half to said container, and (iv) an internal closure mechanism disposed within said lid and adjacent said hole; said hole penetrating said two lid-halves; each said lid-half having an interior surface, an exterior surface, and a tab extending from said exterior surface; said internal closure mechanism having a curved portion for engaging the side wall of the cup of the toilet plunger and a linear portion for engaging the end wall of the cup of the toilet plunger; by depressing each said tab of said lid-halves causing each said lid-halves to pivot about said hinge mechanism to open and expose said interior of said container;

(b) lowering the toilet plunger into said interior of said container;

(c) engaging the end wall of the cup of the toilet plunger against said linear portion, causing said lid-halves to pivot shut to close said device;

(d) resting the end wall of the cup of the toilet plunger in said container and enclosing both the cup of the toilet plunger and a portion of the handle of the toilet plunger and wherein a remainder of the handle protrudes through said hole in said lid;

(e) grasping the handle and pulling the handle toward said lid-halves; and (f) engaging the side wall of the cup of the toilet plunger against said curved portion, causing said lid-halves to pivot open to open said device.

22. A method of cleaning a toilet plunger using a device for storing and cleaning a toilet plunger having a handle with an opposed end, and a cup disposed at one end thereof and having a sidewall terminating in a cup end wall, said method comprising the steps of:

(a) opening a device comprising (i) an open-topped container having an interior defined by upstanding walls and a base, said walls having a spout portion defining a pour spout, (ii) a lid having two lid-halves and a hole there through, each lid-half having an interior surface, an exterior surface, and a tab extending from said exterior surface; said hole penetrating said two lid-halves, (iii) a hinge mechanism connecting each said lid-half to said container, and (iv) an internal closure mechanism disposed within said lid and adjacent said hole, said internal closure mechanism having a curved portion for engaging the side wall of the cup of the toilet plunger and a linear portion for engaging the end wall of the cup of the toilet plunger, by depressing said tabs on said lid-halves causing each said lid-half to pivot about said hinge mechanism opening and exposing said interior of said container;

(b) pouring a cleaning solution into said container;

(c) lowering the toilet plunger into said container;

(d) engaging the end wall of the cup of the toilet plunger against said linear portion, causing said lid-halves to pivot shut, closing said device;

(e) resting the end wall of the cup of the toilet plunger in said container and enclosing both the cup of the toilet plunger and a portion of the handle of the toilet plunger and a remainder of the handle protrudes through said hole in said lid;

(f) soaking the toilet plunger in the cleaning solution; and (g) tipping said device and draining the cleaning solution from said device through said pour spout.

* * * * *